US006595755B2

(12) United States Patent
Brioude et al.

(10) Patent No.: US 6,595,755 B2
(45) Date of Patent: Jul. 22, 2003

(54) CONFIGURATION FOR AXIAL RETENTION OF BLADES IN A DISC

(75) Inventors: Michel Antoine Brioude, Bois le Roi (FR); Charles Jean Pierre Douguet, Vulaines sur Seine (FR); Jack Pierre Lauvergnat, Savigny le Temple (FR); Alain Pierre Vegnant, Lesigny (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 09/750,758

(22) Filed: Jan. 2, 2001

(65) Prior Publication Data

US 2001/0007633 A1 Jul. 12, 2001

(30) Foreign Application Priority Data

Jan. 6, 2000 (FR) ..... 00 00110

(51) Int. Cl.[7] ..... F01D 5/32
(52) U.S. Cl. ..... 416/220 R; 416/221
(58) Field of Search ..... 416/220 R, 221

(56) References Cited

U.S. PATENT DOCUMENTS 3,556,675 A 1/1971 Howald et al.
3,656,865 A * 4/1972 Spears, Jr. ..... 416/221
4,247,257 A * 1/1981 Benoist et al. ..... 416/221
4,304,523 A * 12/1981 Corsmeier et al. ..... 416/221
4,344,740 A * 8/1982 Trenschel et al. ..... 416/221
4,453,890 A * 6/1984 Brantley ..... 416/220 R
4,478,554 A * 10/1984 Surdi ..... 416/221
4,723,889 A 2/1988 Charreron et al.
5,151,013 A * 9/1992 Moore ..... 416/221
5,259,728 A * 11/1993 Szpunar et al. ..... 416/221 X
5,302,086 A * 4/1994 Kulesa et al. ..... 416/221
5,330,324 A * 7/1994 Agram et al. ..... 416/220 R
5,522,702 A * 6/1996 Kemsley et al. ..... 416/221 X
5,540,552 A * 7/1996 Surdi ..... 416/220 R
5,622,476 A * 4/1997 Adde et al. ..... 416/221
5,820,347 A * 10/1998 Bussonnet et al. ..... 416/221

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

This axial mounting of the bottoms (5) of fan blades provides two levels of flexibility, and features rather low stiffness after using up a predetermined clearance (35) between two stop parts (32, 34), which then imposes a significant increase in stiffness; however significant energy was able to be absorbed through the elastic deformation of certain parts (7, 30) located between the blade and the disc (2), which enables the blade to withstand rather significant momentary forces, for example if a neighboring blade breaks and strikes it.

8 Claims, 4 Drawing Sheets

CONFIGURATION FOR AXIAL RETENTION OF BLADES IN A DISC

BACKGROUND OF THE INVENTION

This invention relates to a configuration for retention of blades in an axial direction in a disc of a turbine engine which may in particular be used in fans at the inlet of the latter.

DISCUSSION OF BACKGROUND

The concern here is damage situations which may occur when a blade breaks through an impact produced by a foreign body entering the engine or upon a fault. The blade let loose strikes its neighbor and exerts significant axial and radial stresses on it which may break it in turn.

SUMMARY OF THE INVENTION

With the device provided herein, the axial component of an impact force exerted on the blade may be absorbed. This is a special configuration involving shims for securing the blade, located between the disc and a bottom of the blade which slides in a groove, and which stops its axial movement in the groove.

The securing parts form a relatively flexible set with deformation capabilities which are exploited here, by letting the blade move in the groove up to a determined limit. Relatively significant energy is absorbed without there being any excessive force exerted on the struck blade. The deformation is reversible, i.e. the shims of the securing set return to their initial state after the impact, the blade is pushed back to its initial position, other impacts may further be absorbed, and notably other impacts subsequent to the initial impact may be absorbed during the same event.

This assembly, elastic in the axial direction, of a blade sliding in an axial or slightly oblique groove differs from known configurations, where the blade is either stiffly connected to the disc and is denied any possibility of axial travel, or is axially retained by a part capable of breaking or buckling in the case of an excessive axial force. The blade undergoing the impact is likely to break easily in the first case, and the broken or buckled part will be unable to withstand other high loads during the same event, in the second case.

Another aspect of the invention is that deformation which the securing parts may undergo, is nevertheless limited, so that they do not retain permanent deformations: a stop is added for this purpose between the blade and the disc. When displacement of the blade has been sufficient for it to reach the stop position, the mechanical system becomes much stiffer, i.e. much more significant stress increases are required for producing further displacements. The energy from the axial impact as well as stresses are then distributed among both levels of the retention configuration of the stop system, and the breaking of either one of the systems is avoided.

The first level's retention has such a flexibility that it enables the blade to slide into the recess of the disc without any significant axial stress before intervention of the second level after reaching an imposed clearance and, at this moment, the blade is retained by including the stiffnesses and capabilities of the configuration.

The utility of the invention is not limited to the absorption of impact forces subsequent to a breaking of a neighboring blade, but to all the causes of axial stresses on the blade, such as impacts from solid bodies, birds or other objects.

It will be seen that a great number of embodiments, externally different from one another, are possible for the invention, but a general definition for the latter is a configuration for retaining a blade in a disc where the blade may substantially slide axially in the disc, comprising shims for securing the blade, characterized in that the securing parts are joined together by couples of axially directed stop surfaces and finishing either on a portion of the disc or on one of the securing parts, which is combined with the disc, wherein the securing parts or the portion of the disc are at least partly flexible, and in that there is a determined clearance in the axial direction either between a portion of the disc or a portion of a part joined to the disc, and either a portion of the blade, or a portion of a part joined to the blade, said clearance is exhausted when a determined axial stress has been exerted on the blade. In other words, it may be stated that the invention is also related to a configuration for retaining with double flexibility a blade in a disc according to axial displacements of the blade, comprising a first deformation level with significant flexibility and a second deformation level marked by disappearance of clearances between at least a chain of components of the configuration and by a reduction in flexibility combined with an increasing load on the components of the chain, without any breaking or buckling of any of the components of the chain.

The configuration may be located on only one side of the blade, or on either side, wherein advantageously the clearance is then on one side and the securing parts on the other.

BRIEF DESCRIPTION OF THE DRAWING

All this, as well as more particular aspects will be more apparent in the description which follows, in conjunction with the appended drawings and which are listed below.

DETAILED DESCRIPTION OF THE PREFERRED EMBODIMENTS

Figure 1:
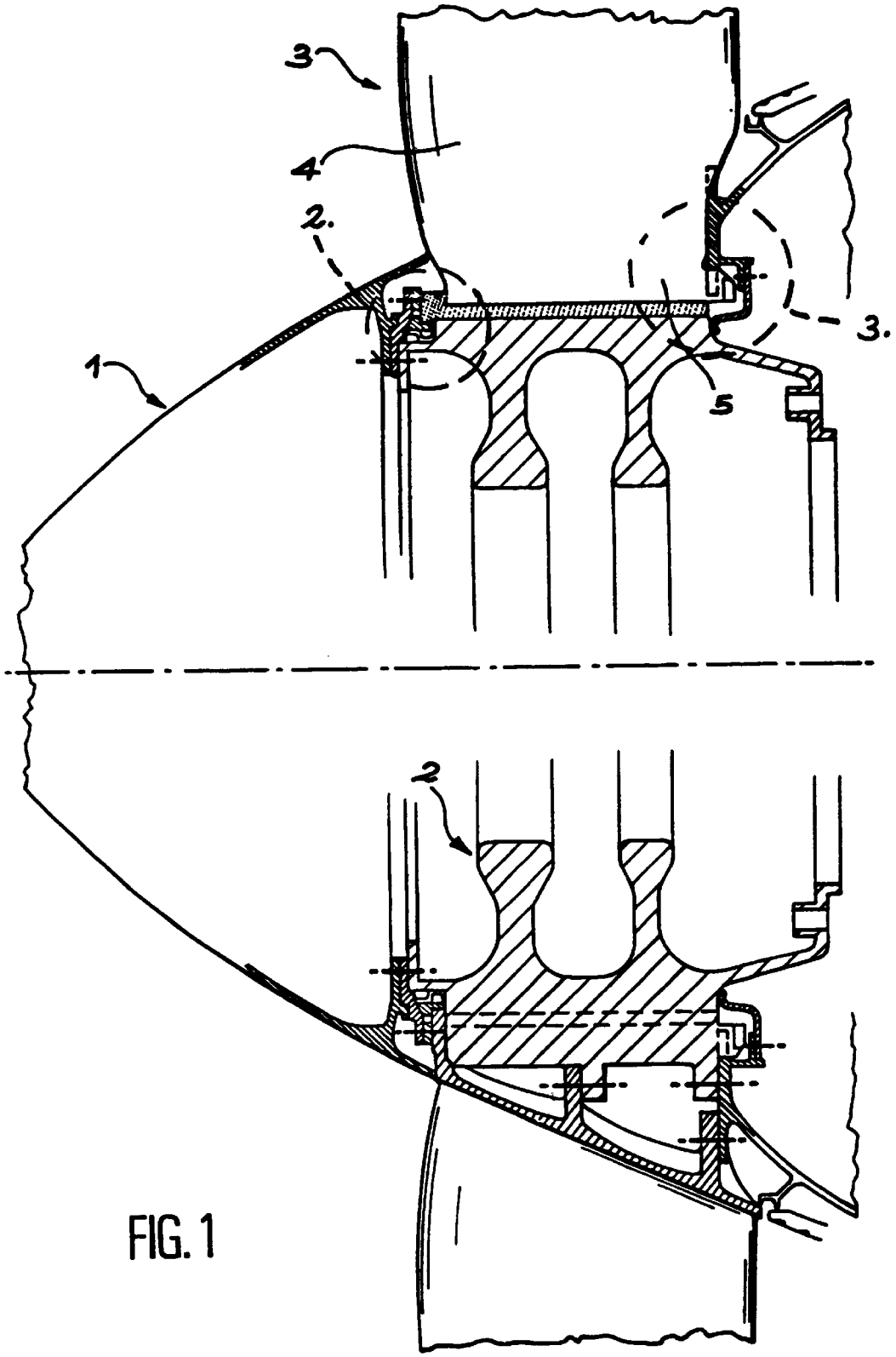
FIG. 1 is a cross-sectional view of a first embodiment of a portion of a fan of the present invention showing an assembly for fixing the blades.

FIG. 1 illustrates certain essential parts of a fan for a turbo engine, including a cone 1, a disc 2 covered by the cone 1 and blades 3 the fins 4 of which emerge from cone 1 and which further comprise bottoms 5 housed within the grooves of disc 2. As it is known, the blade bottoms analogously have a bulbous, dovetail or bulging section in a complementary shaped groove, so as to be embedded within it and prevent centrifugal movements from extracting the blades 3 when cone 1 rotates with the rotor of the turbo engine.

Figure 2:
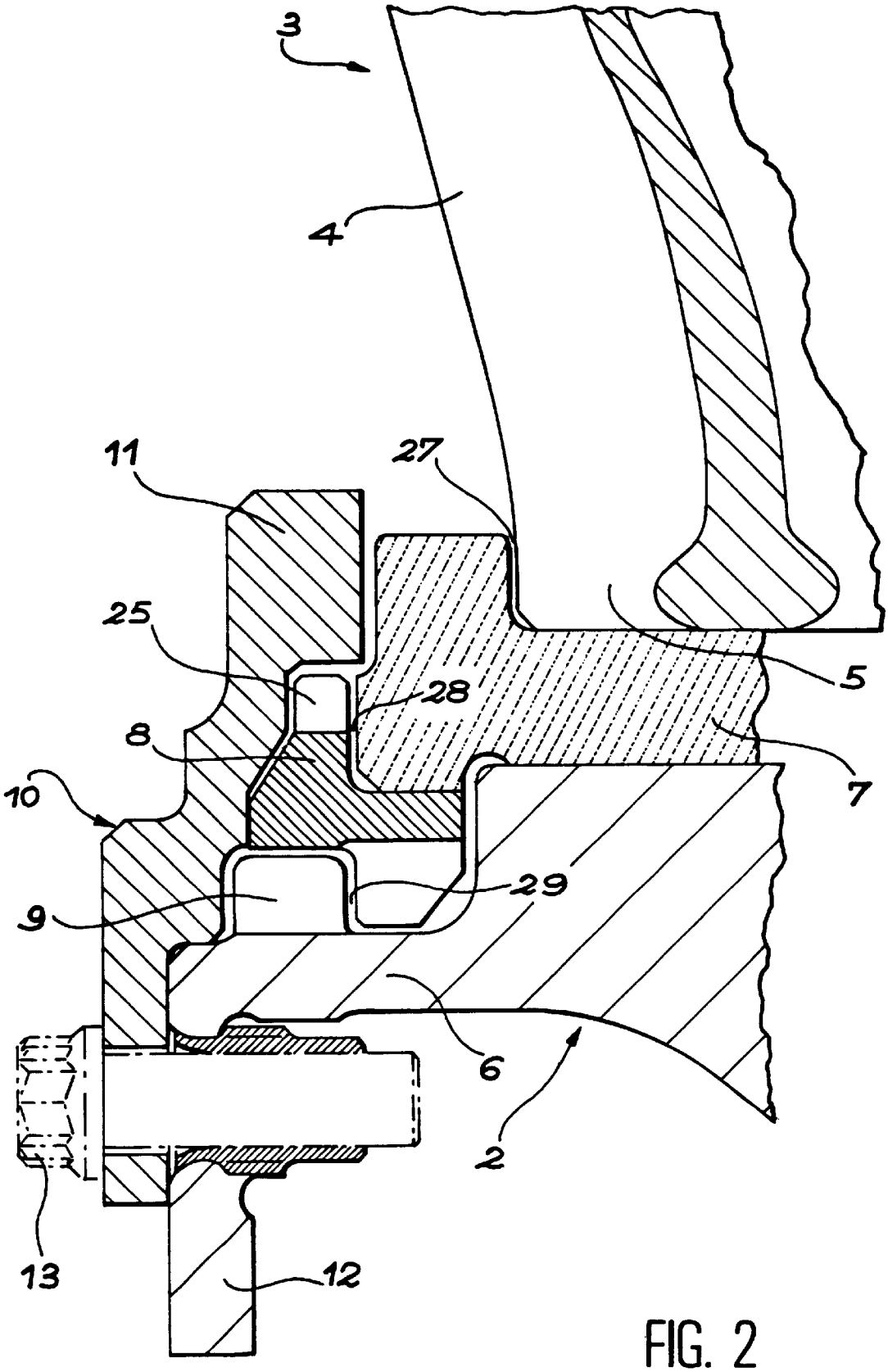
FIGS. 2 and 3 are enlarged views of the cross-section of FIG. 1 showing the detail of both ends of the configuration for retaining the blades which is within the dashed circle II and III, respectively, of FIG. 1.

Now, more particularly, reference will be made to FIG. 2 which shows the front of the configuration. The blade bottom 5 is placed on a shim 7 which holds it in place against the top of the groove by protruding forwards, where shim 7 abuts against a circumferential retention ring 8 which itself abuts forwards against a rim 9 of disc 2. The circumferential retention ring 8 has steps 25 with a limited angular extent which receive the ends of shim 7 and prevents them from axially moving in grooves, as it is known. Furthermore, a flange 10 covers ring 8, rim 9, and shim 7 and is exhibited as a rather thin envelope 11 attached to an external portion 12 of disc 2 via screws 13.

An important aspect of the invention lies in the couples of stop surfaces 27, 28 and 29, facing each other, surfaces positioned on bottom 5 and shim 7, on shim 7 and ring 8, and on ring 8 and rim 9, respectively, these surfaces are directed in an axial direction.

When the blade bottom 5 is moved forwards, it pushes back shim 7, then ring 8, until rim 9 is touched, by successive contact of the couple surfaces 27, 28 and 29. However, this stacking in the axial direction is relatively flexible because of the number of involved parts and of their capabilities of undergoing deformation, especially by bending and torsion of ring 8 owing to its thinness and to radial shifting of the couples of stop surfaces 28 and 29 between which it is located: further displacement of the blade bottom 5 by a determined value will therefore require that a certain force be exerted, but a relatively weak force in a first deformation stage. A neck 6 of disc 2, leading to rim 9, also bends under the load and provides extra flexibility.

Figure 3:
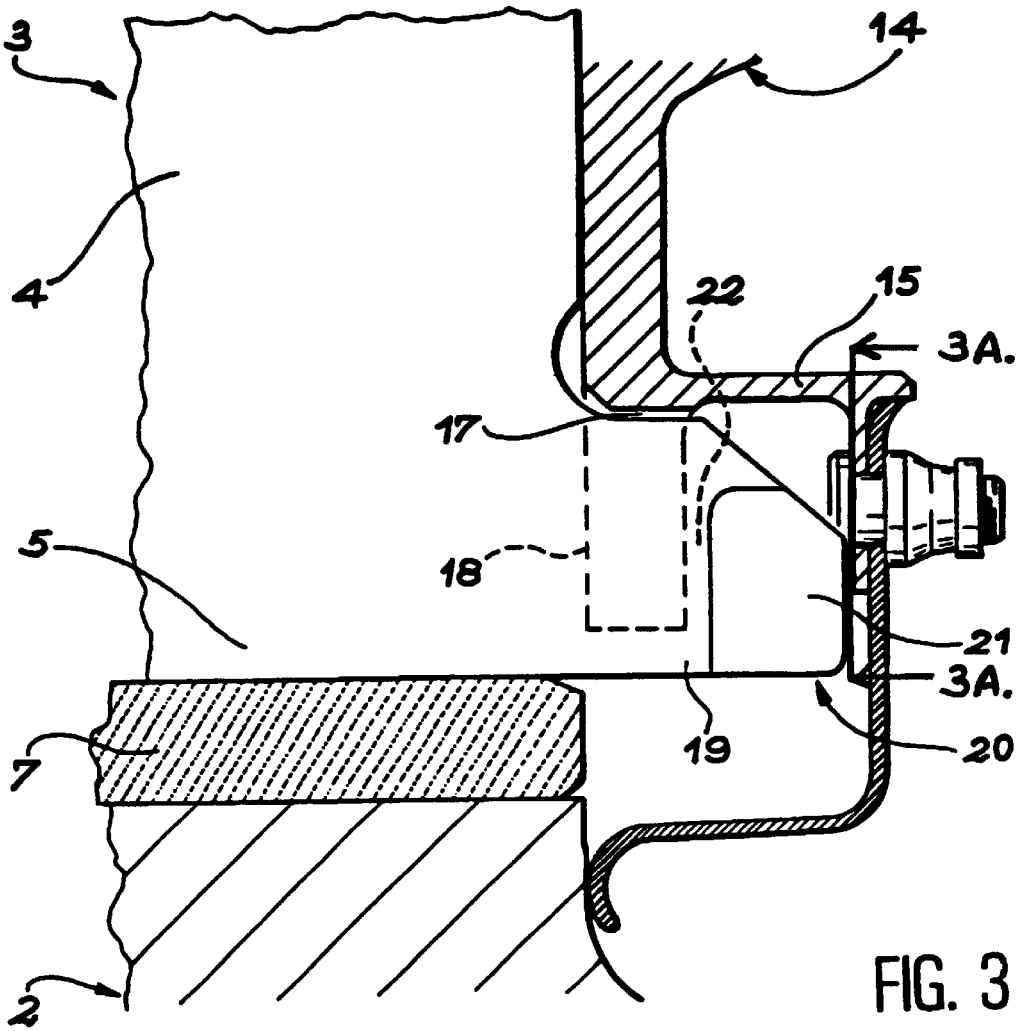
Figure 3A:
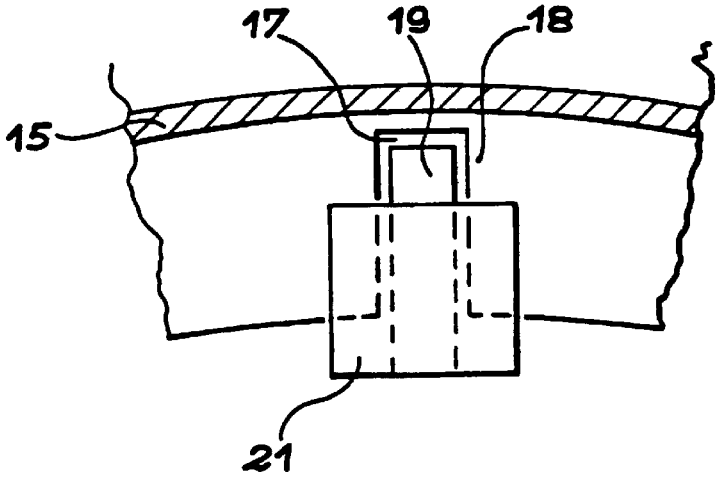
FIG. 3A is cross-sectional view of an essential component of FIG. 3 taken along line IIIA—IIIA of FIG. 3.

FIG. 3 is now considered wherein the other side of disc 2 and of blade 3 is illustrated.

Disc 2 is bolted therein to a drum 14 which comprises a rim 15 finishing as a cap which covers the blade bottom 5 and shim 7. Furthermore, drum 14 is provided with a rim with notches 17, each one of which caps a tenon 19 of a rear portion 20 of blade bottom 5, and a lug 21 of this rear portion 20 extends behind rim 18, from which it is separated in normal circumstances by a determined clearance 22, when the blade does not undergo any significant axial stress. In the event of this occurring and of the blade moving forward, clearance 22 is progressively reduced but remains when parts 7, 8 and 9 start to undergo deformation. When the latter has reached a certain value, clearance 22 is exhausted and direct contact is established between lug 21 and rim 18; as both of these parts are much stiffer than those from the front of the assembly, much larger forces are required for further displacing the blade forwards, as a result, a blade assembly is obtained, slightly stiff for small displacements but highly stiff for larger displacements. This property provides absorption of rather significant impact energies, received by the blade in exceptional loading circumstances like the swallowing up of birds or especially the loss of a blade, without any risk of damaging the different parts of the retention configuration.

Figure 4:
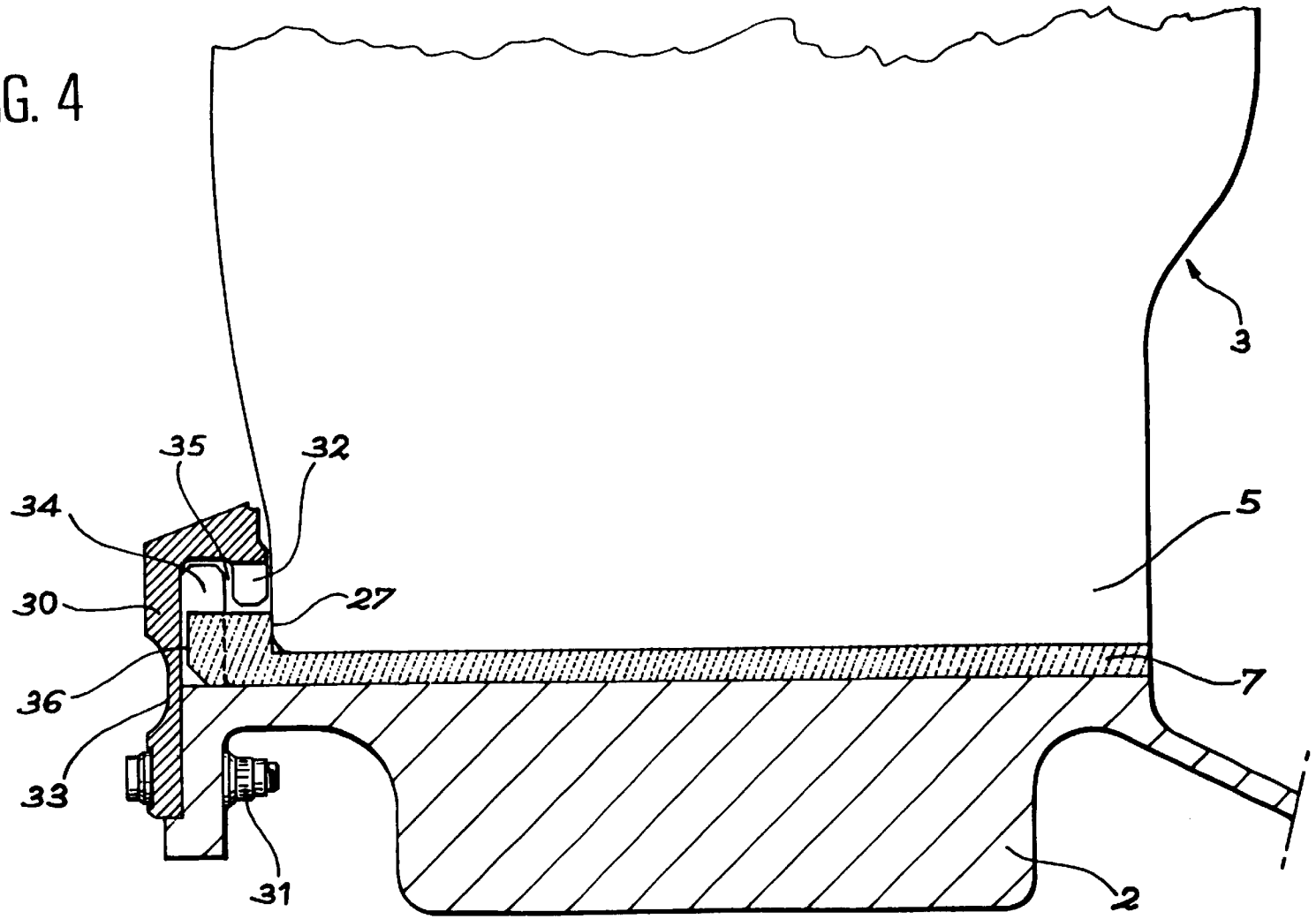
FIG. 4 is a cross-sectional view of a second embodiment of a portion of the fan of the present invention.

This assembly design for the blade with two successive levels of stiffness may be implemented through technical configurations exhibiting a different aspect, as shown in FIG. 4. The blade bottom 5 is again placed on a shim 7 mounted in the same groove of disc 2, and its position on the circumference may be provided by a part analogue to ring 8, which however is not illustrated here and is no longer involved in the assembly of the invention. Here, a flange 30 covers shim 7 and blade bottom 5 at the front; it is joined to disc 2 by bolts 31 and radially extends towards the outside before its bending into the shape of a hook 32 with a limited angular extent which is located facing the blade bottom 5; it comprises, not far from bolts 31, a thinned portion 33 which provides it with increased flexibility. Moreover, disc 2 comprises a rim 34 extending towards the outside, provided with steps of limited angular extent and finishing behind the hook 32 also stepped, between it and the actual flange 30. The steps of hook 32 and of rim 34 are extended so that the solid portions of the two parts face each other and are normally separated by clearance 35.

In this design, all the components of the assembly with two stiffness levels are therefore located at the front of the blades, whereby clearance 35 plays the role of former clearance 22. When a blade undergoes a force in the forward direction, the bottom of blade 5 pushes back shim 7 by having flange 30 bend through its thinned portion 33, until clearance 35 has disappeared and hook 32 abuts against rim 34, much stiffer than flange 30, which strongly increases the strength of the assembly with regards to further displacements of the blade. Deformation of the securing parts is accomplished by the stop between both couples of surfaces 27 and 36, located on bottom 5 and shim 7 (as above), and between shim 7 and flange 30, respectively.

What is claimed as new and desired to be secured by Letters Patent of the United States is:

1. A rotor assembly comprising:

a disc;

a blade sliding in the disc in a substantially axial direction of the disc;

a first stop system including securing parts, the securing parts being at least partially flexible and being located between the disc and the blade; and a second stop system including a pair of opposing portions, the opposing portions being separated by an axial clearance, a first one of the opposing portions being provided on either the disc or a part secured to the disc and a second one of the opposing parts being provided on either the blade or a part secured to the blade, wherein when the blade is subjected to a predetermined force, the blade is displaced in the substantially axial direction with respect to the disc, the securing parts are displaced towards each other so that stop surfaces of the securing parts contact each other, the securing parts become temporarily deformed upon contact with each other, and a length of the axial clearance between the opposing parts becomes equal to zero, and wherein when the predetermined force on the blade is stopped, the blade is displaced back to an original position thereof, the securing parts are displaced back to original portions thereof so that the stop surfaces of the securing parts are no longer in contact with each other, and the securing parts are no longer deformed due to the at least partial flexibility of the securing parts.

2. The rotor assembly according to claim 1, wherein the first stop system and the second stop system are located on opposite sides of the blade in the substantially axial direction of the disc.

3. The rotor assembly according to claim 1, wherein the securing parts comprise a portion of a shim located under a bottom of the blade.

4. The rotor assembly according to claim 3, wherein the securing parts comprise a ring for circumferentially retaining the shim.

5. The rotor assembly according to claim 4, wherein the ring has a first stop surface and a second stop surface of the stop surfaces of the securing parts, the first stop surface being radially offset from the second stop surface.

6. The rotor assembly according to claim 4, wherein the securing parts only comprise the portion of the shim and the ring.

7. A rotor assembly comprising:

a disc;

a blade sliding in the disc in a substantially axial direction of the disc;

a first stop system including securing parts, the securing parts being at least partially flexible and the securing parts being located between the disc and the blade; and a second stop system including a pair of opposing portions, the opposing portions being separated by an axial clearance, a first one of the opposing portions being provided on the disc, and a second one of the opposing portions being provided on one of the securing parts which is at least partially flexible and which is secured to the disc, wherein when the blade is subjected to a predetermined force, the blade is displaced in the substantially axial direction with respect to the disc, and the securing parts are displaced toward each other until stop surfaces thereof contact each other thereby causing the securing parts to become temporarily deformed and a length of the axial clearance between the opposing portions becomes zero, and wherein when the predetermined force on the blade is stopped, the blade is displaced back to an original position thereof, the securing parts are displaced back to an original position thereof so that the stop surfaces of the securing parts are no longer in contact with each other, and the securing parts are no longer deformed due to the at least partial flexibility of the securing parts.

8. The rotor assembly according to claim 7, wherein one of the securing parts, which is at least partially flexible, is a flange covering a bottom of the blade, and the opposing portions are a hook of the flange and a rim of the disc, the flange comprising a thinned flexible portion located between the hook and a position where the flange is attached to the disc.

* * * * *